US005080684A

United States Patent [19]

Simon

[11] Patent Number: 5,080,684

[45] Date of Patent: Jan. 14, 1992

[54] FLOATING DEVICE FOR RELEASING SAFETY EQUIPMENT

[76] Inventor: Henri G. Simon, 43 Chemin de Porce, F-44600 Saint-Nazaire, France

[21] Appl. No.: 241,327

[22] Filed: Sep. 6, 1988

[30] Foreign Application Priority Data

Jan. 8, 1988 [FR] France ..... 88 00014

[51] Int. Cl.[5] ..... B63B 21/52

[52] U.S. Cl. ..... 441/2; 441/10

[58] Field of Search ..... 441/2, 7, 10, 80

[56] References Cited

U.S. PATENT DOCUMENTS

| | | | |
|---|---|---|---|
| 1,553,097 | 9/1925 | Nanni | 441/32 |
| 2,559,918 | 7/1951 | Grieb | 441/10 |
| 2,994,892 | 8/1961 | Paradis | 441/10 |
| 4,000,533 | 1/1977 | Higgs | 441/7 |
| 4,065,823 | 1/1978 | Lorenzen et al. | 441/10 |

FOREIGN PATENT DOCUMENTS

| | | | |
|---|---|---|---|
| 16190 | 1/1986 | Japan | 441/10 |
| 907001 | 9/1962 | United Kingdom . | |
| 2085812 | 5/1982 | United Kingdom | 441/10 |

*Primary Examiner*—Jesûs D. Sotelo
*Assistant Examiner*—Stephen P. Avila
*Attorney, Agent, or Firm*—Hughes & Multer

[57] ABSTRACT

Floating device for releasing safety equipment, this device being fixed on a unit such as a ship and comprising a support on which a movable member is fixed under the influence of hydrostatic pressure, this member acting on a bolt by means of which the safety equipment is normally secured, characterized in that the movable element (10) consists of a face of a flexible pocket.

29 Claims, 5 Drawing Sheets

FLOATING DEVICE FOR RELEASING SAFETY EQUIPMENT

CROSS REFERENCE TO RELATED APPLICATIONS

This application is a continuation application of P.C.T. patent application No. PCT/FR88/00014 filed on Jan. 8, 1988 which designated the United States and which is now abandoned with respect to the United States.

The invention relates to a device for releasing safety equipment on a unit such as a ship.

The application in Great Britain No. 907,001 and the application in the Federal Republic of Germany No. 1,245,787 already disclose devices for releasing safety equipment which comprise a support provided with a bolt which keeps the safety equipment secured, this bolt being connected to a member which is sensitive to hydrostatic pressure in order that this member activates the bolt and releases the safety equipment when it is immersed to a certain depth in the water.

These members which are sensitive to hydrostatic pressure consist of a rigid hollow enclosure one open end of which is blocked by a substantially plane membrane which is connected to the latch of the bolt. A helical spring is disposed between the base of the rigid enclosure and the membrane in order to keep this membrane in position. When the releasing device is immersed, the hydrostatic pressure of the water being exerted on the membrane displaces this membrane against the spring in order to activate the bolt and to release the equipment which is secured thereto.

Releasing devices of this type produced hitherto do not permit, however, a satisfactory result to be achieved, that is to say a device which is both sufficiently accurate, and has an accuracy which may be repeated from one device to another, in order to be released, in specific climatic conditions, at a specific and sufficiently substantial depth of immersion, whatever these climatic variations may be (pressure and temperature), which may be considerable as a function of daily and seasonal variations and variations due to geographical zones of use of the device.

Operating defects of these known devices are, in fact, a result of the shape of the membrane, which is substantially plane and which is fixed rigidly at its periphery, and of the presence of the spring.

In fact, the parameters of the spring must be determined by making a compromise between the strength of the spring which determines the depth of immersion which ensures release and the weakness of the spring which determines operating sensitivity.

Moreover, the force of the spring which maintains the position of the plane membrane must, in principle, be sufficiently high in order to prevent release, whatever the climatic conditions may be. It follows that the depth of immersion for release must also be relatively large and this reduces sensitivity.

In order to begin to displace the bolt, hydrostatic pressure must also be equal to the pressure of the spring increased by the force necessary to cause deformation of the membrane which is rigidly fixed at its periphery. In point of fact, this force necessary for deformation of the membrane must itself be considerable if it is desired to avoid, before release, the increase in external pressure causing deformation of the membrane in the vicinity of its periphery by ensuring balanced internal and external pressures.

The aim of the present invention is to remedy these drawbacks and relates, to this end, to a floating device for releasing safety equipment, this device being fixed on a unit such as a ship and comprising a support on which a movable member is fixed under the influence of hydrostatic pressure, this member acting on a bolt by means of which the safety equipment is normally secured, which device is characterized in that the movable member consists of a face of a flexible pocket which is, moreover, fixed to the support.

According to another characteristic of the invention, the flexible pocket is produced by moulding, the nature of the moulding material and the wall thickness of the pocket being such that, in the absence of stresses, the moulded flexible pocket is maintained in its moulding shape.

According to another characteristic of the invention, the flexible pocket is produced in the form of an air-chamber envelope having two faces, one of which is connected to the bolt and the other of which is fixed to the support.

According to another characteristic of the invention, the support forms a cradle for the safety equipment and the flexible pocket fixed to the support is connected to the bolt, ensuring securing of the safety equipment resting on the support cradle.

The invention is represented by way of non-limiting example in the attached drawings, in which.

Figure 1:
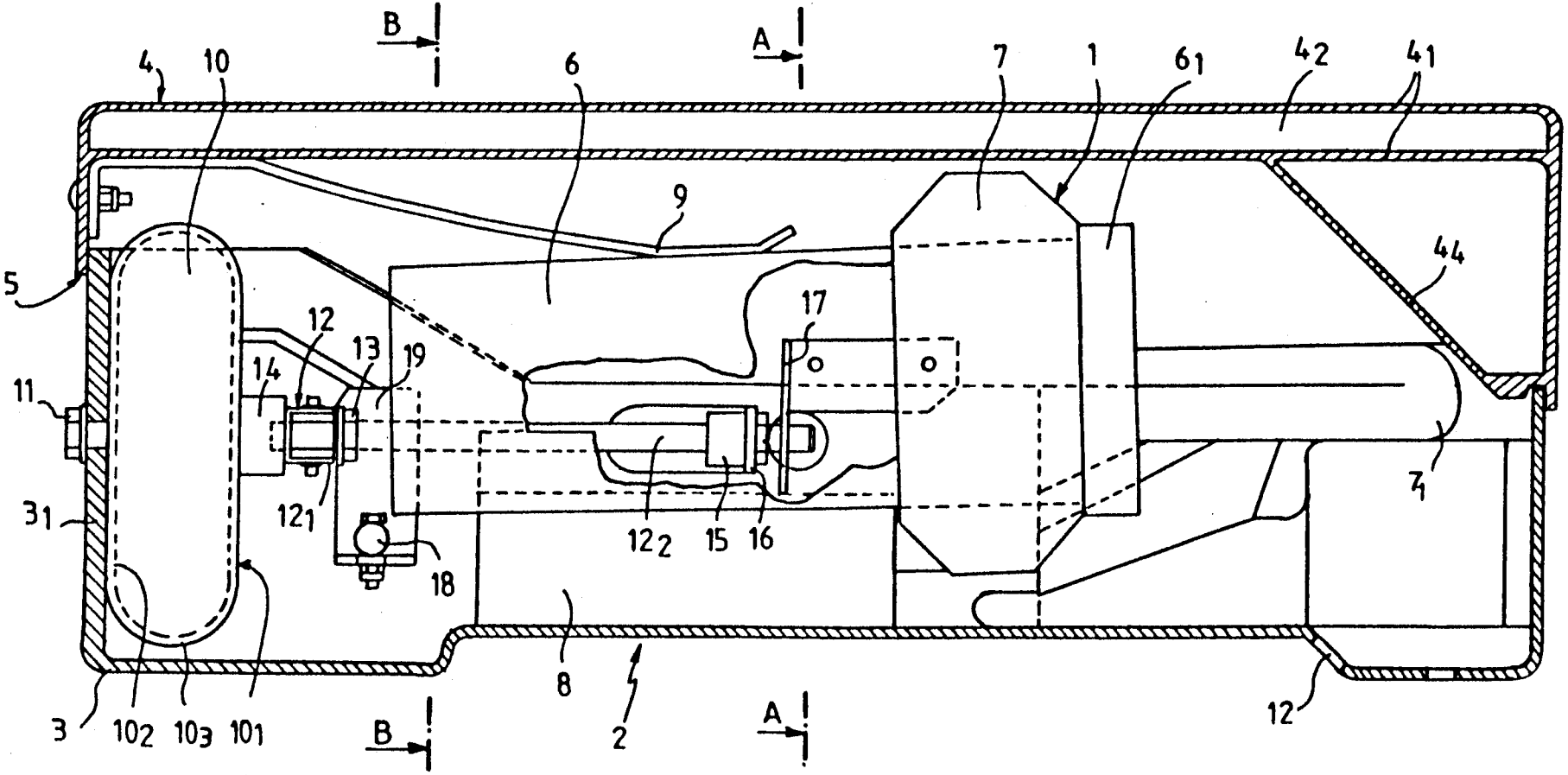
FIG. 1 is a view in longitudinal section of a first embodiment of the device according to the invention.
Figure 2:
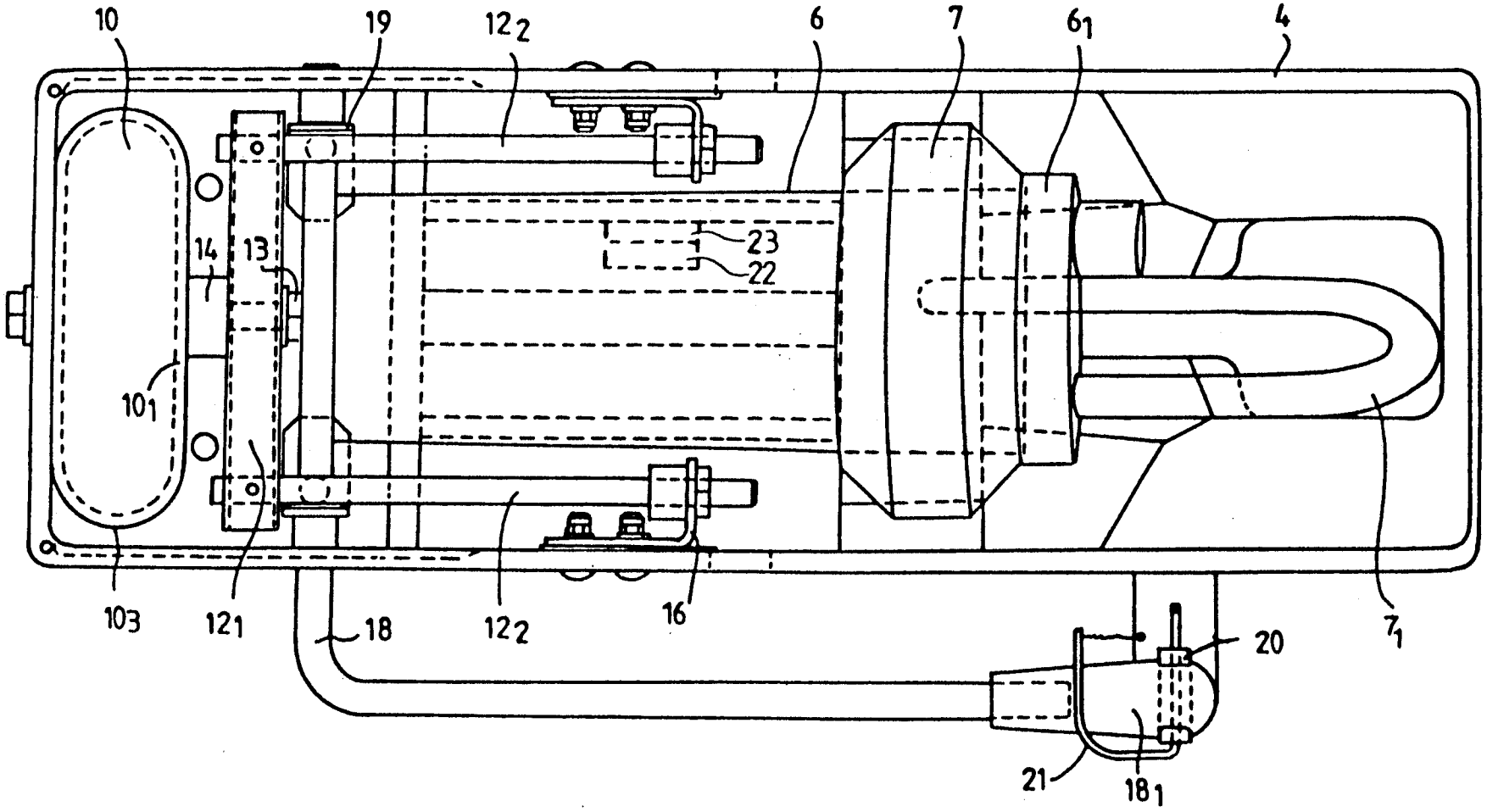
FIG. 2 is a plan view of FIG. 1, the cover having been removed.
Figure 5:
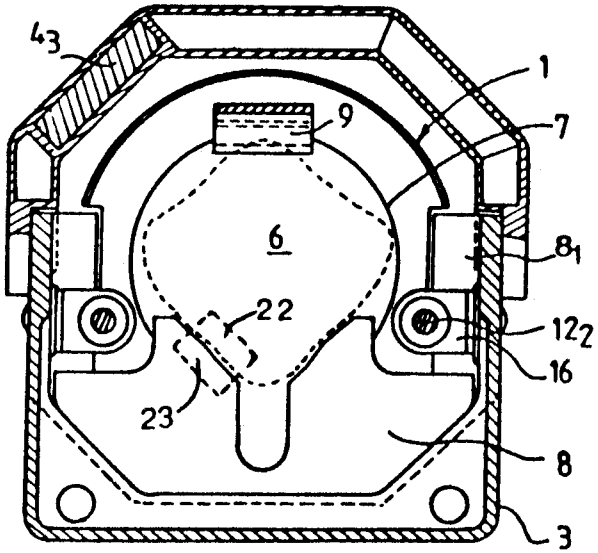
FIGS. 5 and 6 are, respectively, sections along A—A and B—B of FIG. 1.
Figure 6:
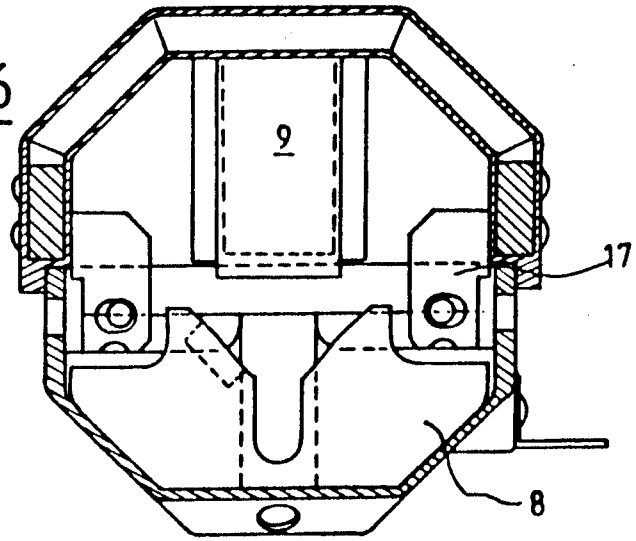
Figure 3:
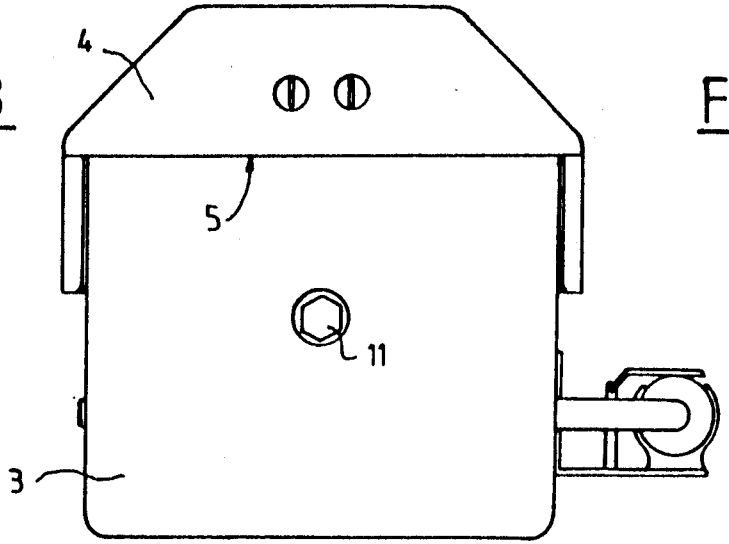
FIGS. 3 and 4 are, respectively, views from the left and from the right of FIG. 1.
Figure 4:
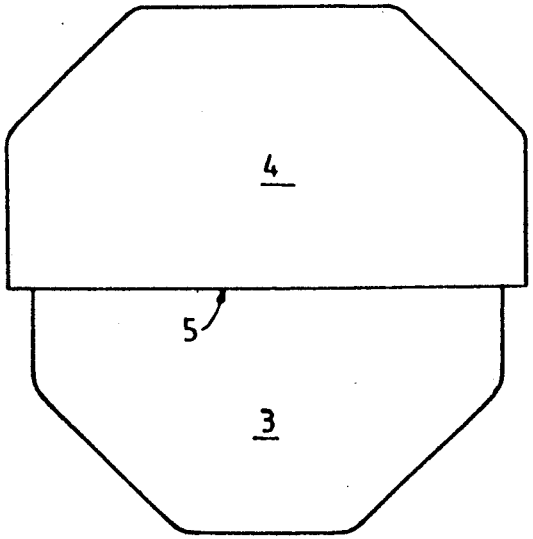

The device represented on FIGS. 1 to 6 constitutes a device for releasing safety equipment 1, this equipment being, to this end, enclosed in a support casing 2 comprising two elements in the form of shells 3 and 4 which are assembled along a joint plane 5. One of these shells 3 is intended to be fixed to a unit such as a ship, an offshore drilling platform, an aircraft, etc., whilst the other 4 is produced so as to float and is intended to be separated from the shell 3 when the unit in question has gone down and has reached a certain depth, in order to release the safety equipment 1. This safety equipment constitutes, for example, a floating radio-transmitter buoy with which a light beam source is optionally associated and consists of a body 6 inside which the electronic part of the buoy is housed, this body comprising near its upper end $6_1$ a float 7 and the transmitter antenna $7_1$.

The buoy 1 is held resting on blocks 8 forming a cradle and which are provided in the shell 3. The shell 4, which is normally locked to the shell 3, comprises a spring leaf 9 by means of which it rests on the body 6 of the buoy in order to keep it in position. The shell 4 which forms a cover is produced so as to float and comprises, to this end, a double wall $4_1$ defining a floating zone $4_2$ therebetween.

Moreover, the floating shell 4 comprises a ballast $4_3$ (see FIG. 5) which is preferably inserted in the thickness of the wall of the shell and whose weight and position are determined so as to cause turning of this shell 4 when it is separated from the shell 3. This arrangement makes it possible to guarantee that the buoy 1 does not remain wedged in the shell 4 after the latter has separated from the shell 3.

In addition, opposite the upper end $6_1$ of the buoy, the shell 4 has an inclined surface $4_4$ ending in the joining surface 5 intended to prevent the upper end of the buoy being able to rest blocked against the end of the cover 4 after its separation.

Inside the casing 2 forming the support of the buoy 1 there is disposed a member 10 which is sensitive to hydrostatic pressure and which consists of a flexible pocket produced in the example represented in the form of an air-chamber envelope, which is therefore entirely closed, comprising two plane faces which are opposite and parallel $10_1$ and $10_2$, one $10_2$ of which is fixed, for example by means of a bolt 11, to one of the end faces $3_1$ of the shell 3. This air-chamber envelope which is leakproof and deformable is produced by moulding an elastic material, the nature of the material employed and the thickness of the wall of the envelope being such that, in the absence of stresses, the shape of this envelope is maintained in its molded shape. This arrangement makes it possible to use this envelope, when there is a prevailing interior pressure substantially equal to atmospheric pressure, in a manner such that any difference in pressure between the inside and the outside of the envelope is reflected in a displacement of the movable face $10_1$.

Moreover, this envelope, which is of circular shape with a bulged circular side edge, is defined by the two plane parallel faces $10_1$, $10_2$ which are slightly separated from one another compared with the diameter of the envelope, these two faces $10_1$, $10_2$ having a structure such that they are more rigid than the curved periphery $10_3$ of this circular envelope. This rigidity of the faces $10_1$, $10_2$ may be produced by inserting a rigid plate in the wall thickness of the envelope.

When the releasing device is plunged into the water, these arrangements cause the water penetrating in the casing 2 via the orifices 12 to exert a pressure on the face $10_1$ in a manner to bring it closer to the face $10_2$, this displacement being slightly limited by the internal pressure of the envelope, given, on the one hand, that this pressure is initially equal to atmospheric pressure and, on the other hand, that the increase in pressure resulting from the two faces $10_1$ and $10_2$ approaching each other is reduced by the correlative expansion of the circular curved periphery $10_3$ of the envelope.

In the example represented, the pocket 10 is produced in the form of an air-chamber envelope which is plane, closed and leakproof. However, if deemed preferable for reasons of manufacturing cost, this pocket may have an opening bounded about the periphery $10_3$ while the periphery will be fixed in a leakproof manner either directly to the end $3_1$ of the shell 3 or indirectly to a separate plate replacing, in this place, the face $10_2$ of the envelope.

These embodiments of the flexible pocket enable safe and accurate operating of the device to be obtained in order to cause the release of the buoy 1 which is secured in the casing 2 at a depth of immersion which is specific for the specific climatic conditions (temperature and pressure) and, very importantly, with satisfactory sensitivity, whatever these climatic conditions may be.

The two shells 3 and 4 of the casing are normally held locked to one another, in order to keep the buoy 1 secured, the bolt comprising a U-shaped stirrup 12 whose base $12_1$ is fixed by means of a screw 13 to a stud 14 provided in the central zone of the face $10_1$ of the envelope 10. The two branches $12_2$ of this stirrup 12 slide freely in the rings 15 mounted on lugs 16 fixed to the inner face of the shell 3. Moreover, the free end of these branches $12_2$ forming the latches is housed in the orifices having a corresponding section and which form notches provided on lugs 17 (see FIG. 1) fixed to the inner wall of the shell 4 for its locking together with the shell 3.

It will thereby be understood that, when the pocket 10 is subjected to hydrostatic pressure, the stud 14 is displaced, entraining with it the stirrup 12 in order to release the shell 4 for a specific amplitude of displacement and therefore for a specific value of this hydrostatic pressure.

The device is also provided with a means for manual manoeuvreing, which may be activated from outside the casing and which makes it possible to control both the locking manoeuvre of the shell 4 to the shell 3 or, on the other hand, an unlocking manoeuvre in order to release the buoy 1 in order to check its condition or to cause it to operate before the device has been immersed. In the example represented in the drawings, this manual manoeuvreing is ensured by means of a bent rod 18 mounted so as to pivot on the shell 3 and provided with a manoeuvreing handle $18_1$ at its free end. This rod 18 is provided with two lugs 19 which, when this rod pivots, laterally come up against the ends of the base $12_1$ of the stirrup 12 in order to displace this stirrup against the envelope 10.

In order to prevent the unexpected manoeuvreing of the rod, the latter is locked by a lock. In the example represented, the handle 18 is engaged in an open collar 20 in which it is locked by a pin 21.

The device according to the invention also comprises means which hold the buoy 1 in a standby condition whilst it is held secured in its support consisting of the casing 2, and this is so that it may be put into operation automatically when it is released from this support. These means are accomplished, on the one hand, by giving the cradle 8 and the buoy 1 (see FIG. 5) a shape such that this buoy 6 may be placed correctly on the blocks 8 forming a cradle only according to one single angular position.

In the example represented, these means consist (see FIG. 5) of cutouts formed in the float 7 and corresponding projections $8_1$ provided on the cradle 8.

On the other hand, this buoy 1 comprises an electrical contactor and, preferably, a magnetically controlled contactor 22 which is disposed on the wall of the body 6 so that it may be activated by a control means such as a magnet 23 when this buoy 1 is disposed on its cradle 8.

Figure 8:
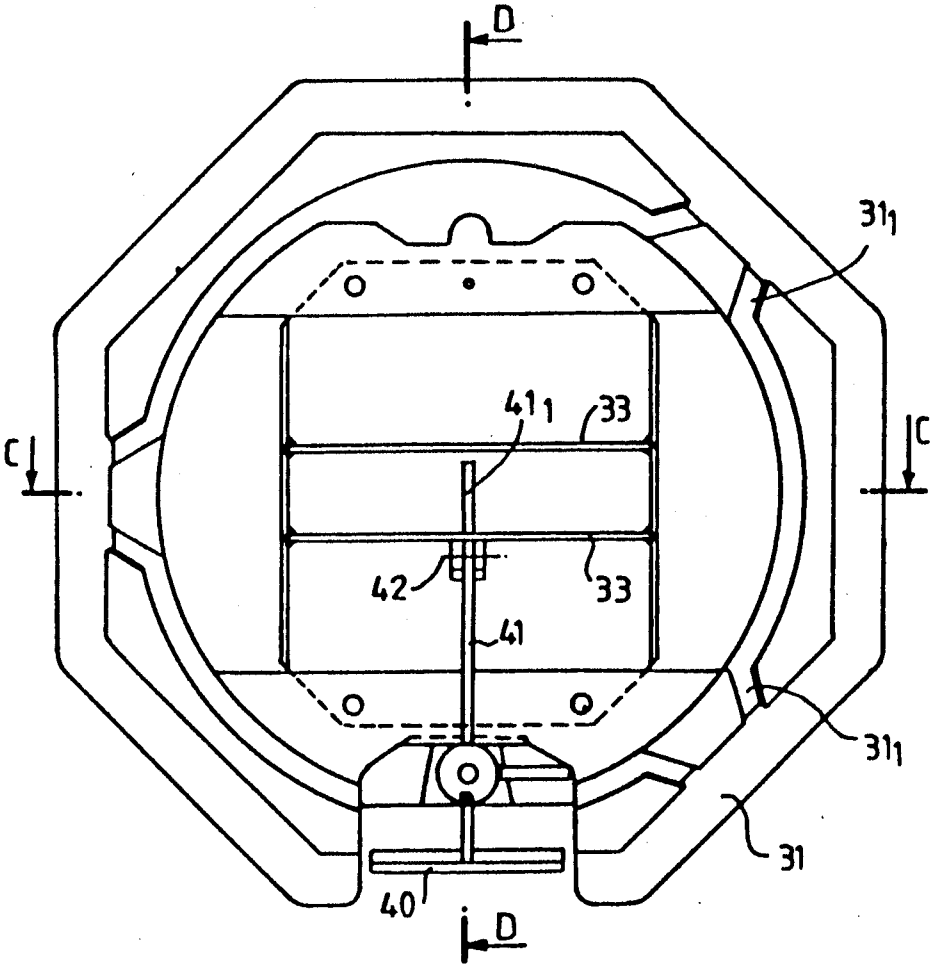
FIG. 8 is a plan view of FIG. 7, the safety equipment having been removed.
Figure 7:
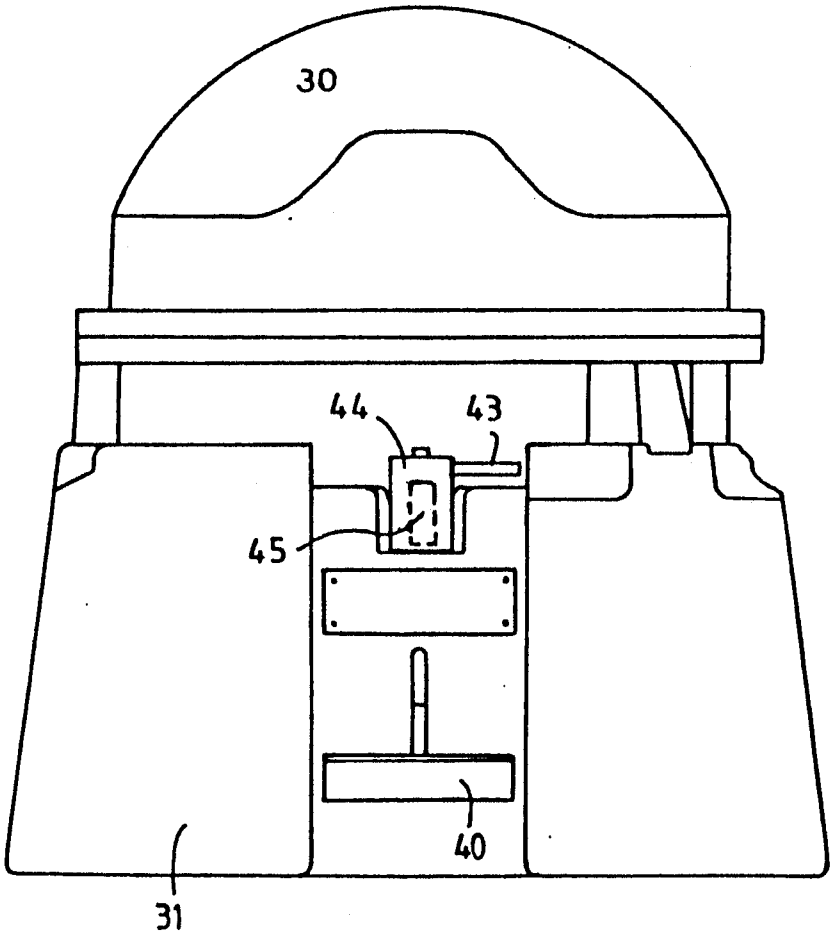
FIG. 7 is a side view of another embodiment of the device according to the invention.
Figure 10:
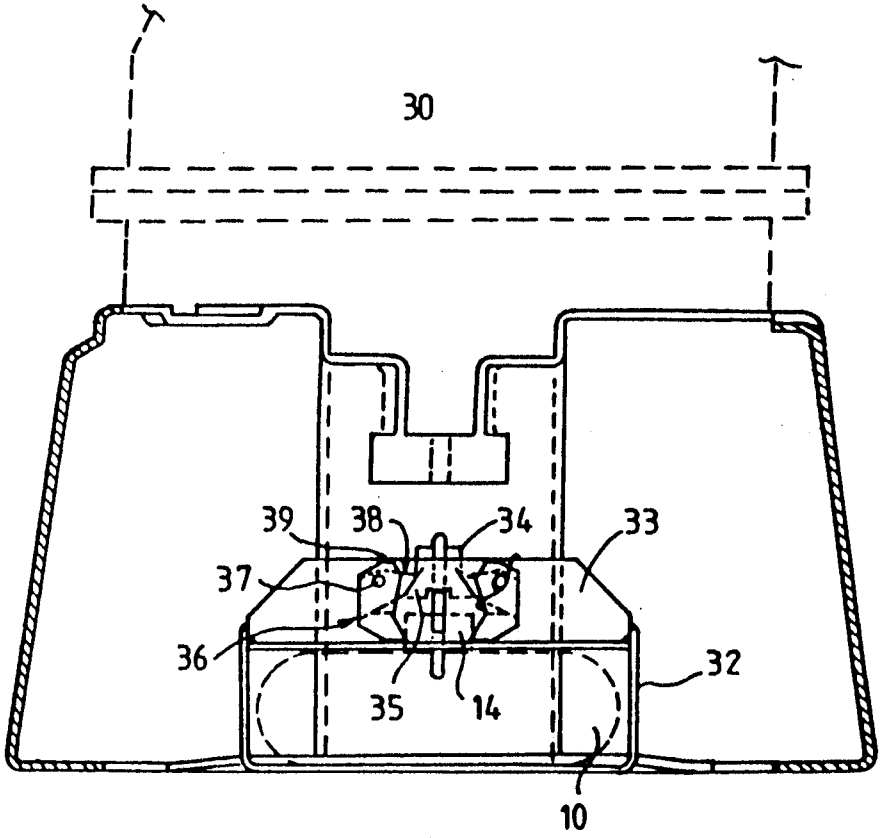
FIGS. 9 and 10 are, respectively, sections along C—C and D—D of FIG. 8.
Figure 9:
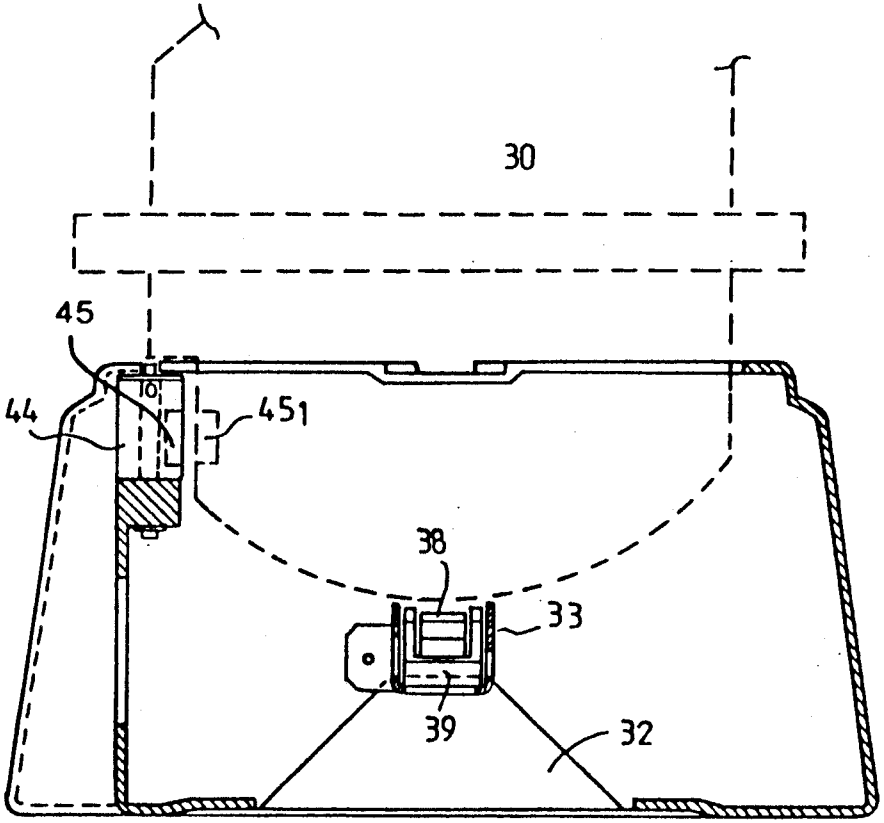

A second embodiment of the invention has been represented in FIGS. 7 to 10, this embodiment being adapted to a type of floating distress buoy 30 whose shape is substantially spherical. This buoy rests on a support 31 in the form of a frustoconical base, at the central part of which is disposed the flexible hollow element forming the pocket 10. This pocket 10 is disposed inside a housing 32 comprising, at its top, a pair of parallel flanges 33 supporting the securing bolt of the buoy 30. In this case, the buoy comprises at its lower end a stud 34 ending in a flange 35 and the bolt consists of jaws 36 mounted so as to pivot opposite one another on spindles 37 fixed between the flanges 33.

In this example, each jaw consists of two elements 38 and 39 which are partially movable with respect to one another by means of pivoting on the spindles 37. These elements 38 and 39, disposed under the action of springs, come to rest, at their ends, against the flange 34 and against the stud 14, respectively, in order to ensure locking of the buoy 30 on the base 31. When the envelope 10 is subjected to a specific hydro-static pressure, the cylindrical stud 14 releases the pivoting elements 39 which commands the pivoting of the elements 38 in order to release the flange 35 and, therefore, the buoy 30.

In order to position the buoy 30, it is sufficient to dispose it on the base 31 in a manner such that the flange 35 causes the elements 38 to pivot against springs. When the flange 35 has passed the elements 38, the latter return to an initial position and the flange is held by these elements 38 and are prevented from pivoting in the opposite direction by the elements 39 which are themselves resting laterally on the stud 14. This arrangement therefore makes it possible to produce automatic securing of the buoy on its support.

As in the example of embodiment of FIGS. 1 to 6, a manoeuvreing handle 40 makes it possible to unlock the buoy from outside the device. In this example of FIGS. 7 to 10, this manoeuvreing handle 40 is fixed to the end of a lever 41 pivoting at 42 on one of the flanges 33 so that the end $41_1$ of this lever, which is housed between the jaws 36, may come up against the end of the stud 14 in order to repel it and thereby release the pivoting elements 39 of these jaws.

The base 31 receives and supports the buoy 30 in the zones $31_1$ which are irregularly distributed in order to produce a correction which will prevent the incorrect angular positioning of the buoy on its support.

The base 31 also comprises a finger 43 connected to a pivoting stud 44. This stud 44 is provided with a drive means, such as a magnet 45 (FIG. 7), intended to act on a corresponding contactor $45_1$ (FIG. 9) disposed opposite the buoy 30. Manoeuvreing the finger 43 makes it possible to place the buoy 30 in a standby condition or to withdraw it from a standby condition as in the example of embodiment of FIGS. 1 to 6. A lock (not shown) consisting of, for example, a pin, may be provided to prevent unexpected manoeuvreing of the finger 43.

I claim:

1. A floating device for releasing safety equipment, this device being fixed on a unit such as a ship and comprising a support on which a movable member is fixed under an influence of hydrostatic pressure, this member acting on a bolt by means of which the safety equipment is normally secured, characterized in that the movable member (10) consists of a face of a flexible pocket in a form of a closed air-chamber envelope having two plane faces, connected by a convex periphery, one of these faces being connected to the bolt (12, 17; 38, 39, 35) and the other ($10_2$) being fixed to the support (3, 11).

2. A device according to claim 1, characterized in that the flexible pocket (10) is manufactured by being formed in a mould, a nature of a material of the pocket and a wall thickness of the pocket being such that in an absence of stresses, the moulded flexible pocket is maintained in a shape in which the moulded flexible pocket was originally formed.

3. A device according to claim 1, characterized in that the support forms a cradle (8, $31_1$) for the safety equipment (1, 30) and the flexible pocket fixed to the support is connected to the bolt ensuring securing of the safety equipment resting on the support cradle.

4. A device according to claim 3, characterized in that a shape of the floating safety equipment (1, 30) and of the cradle (8, $31_1$) is such that the equipment may be housed correctly in the cradle only according to one single position.

5. A device according to claim 1, characterized in that the support consists of two elements (3 and 4) forming a casing which is not leakproof and which completely encloses the safety equipment, its securing bolt, and the flexible pocket (10), one (3) of the elements being fixed to the unit such as a ship, the other element (4) forming a cover.

6. A device according to claim 5, characterized in that the two elements (3, 4) form two shells which are assembled along a joining plane (5).

7. A device according to claim 5, characterized in that the element (4) of the support forming the cover is produced so as to float.

8. A device according to claim 7, characterized in that one of the faces ($10_2$) of the flexible pocket (10) is fixed to one of the elements (3) of the support whilst its movable face ($10_1$), under the influence of hydrostatic pressure interacts with the securing bolt which assembles the two elements (3, 4) of the support.

9. A device according to claim 1, characterized in that it comprises a support (31) in a form of a base which is capable of receiving and supporting the safety equipment (30) and that this support (31) comprises under the said equipment, the flexible pocket (10) and the securing bolt (36) interacting both with the said flexible pocket (10) and with a suitable anchoring stud (34) integral with the lower part of the said safety equipment.

10. A device according to claim 1, characterized in that the floating safety equipment (1, 30) is provided with an electrical contactor (22, $45_1$) disposed so as to be activated by the support (2, 31) when the equipment is positioned on the support or when it is separated from the support.

11. A device according to claim 10, characterized in that the support (31) is provided with a movable means (44), which is accessible from outside the support and which is disposed so as to activate the electrical contactor ($45_1$) of the equipment when it is disposed on the support.

12. A device according to claim 10, characterized in that the electrical contactor (22, $45_1$) is controlled by a magnet, and the support (2, 31) is provided with a magnetic means (23, 45) disposed in a manner to activate this contactor when the safety equipment is positioned on the support or when it is separated from the support.

13. A floating device for releasing safety equipment, this device being fixed on a unit such as a ship and comprising a support on which a movable member is fixed under an influence of hydrostatic pressure, this member acting on a bolt by means of which the safety equipment is normally secured, this device characterized in that the movable member (10) consists of a face of a flexible pocket, and further characterized in that the support forms a cradle (8, $31_1$) for the safety equipment (1, 30) and the flexible pocket fixed to the support is connected to the bolt ensuring securing of the safety equipment resting on the support cradle, wherein the support comprises means (18, 40) for the manual manoeuvreing of the movable face ($10_1$) of the flexible pocket (10) so as to release the safety equipment at will.

14. The device according to claim 13, further characterized in that the manual manoeuvreing means are equipped with locking means (21) for preventing their unexpected manoeuvreing without hindering the automatic release of the safety equipment.

15. A floating device for releasing safety equipment, this device being fixed on a unit such as a ship and comprising a support on which a movable member is fixed under an influence of hydrostatic pressure, this member acting on a bolt by means of which the safety equipment is normally secured, characterized in that the movable member (10) consists of a face of a flexible pocket, and further characterized in that the support consists of two elements (3 and 4) forming a casing which is not leakproof and which completely encloses the safety equipment, its securing bolt and the flexible pocket (10), one (3) of the elements being fixed to the unit such as the ship, the other element (4) forming a cover; wherein the element (4) forming the cover has zones ($4_2$, $4_3$) of different density which are capable of causing it to turn after being separated from the other support element (3) which is fixed to the unit such as the ship.

16. A device according to claim 15, characterized in that the element (4) of the support forming the cover is produced so as to float, and further characterized in that the zones of different density of the floating element (4) which forms the cover comprise at least ballast ($4_3$) fixed to this floating element.

17. A floating device for releasing safety equipment, this device being fixed on a unit such as a ship and comprising a support on which a movable member is fixed under an influence of hydrostatic pressure, this member acting on a bolt by means of which the safety equipment is normally secured, characterized in that the movable member (10) consists of a face of a flexible pocket, and further characterized in that the support consists of two elements (3 and 4) forming a casing which is not leakproof and which completely encloses the safety equipment, its securing bolt, and the flexible pocket (10), one (3) of the elements being fixed to the ship, the other element (4) forming a cover; wherein the element (4) of the support forming the cover is produced so as to float; wherein one of the ends ($6_1$) of the safety equipment (1) and/or the inner face ($4_1$) opposite the floating element (4) of the support is inclined with respect to the joining plane (5) of the two elements of the support.

18. A floating device for releasing safety equipment, this device being fixed on a unit such as a ship and comprising a support on which a movable member is fixed under an influence of hydrostatic pressure, this member acting on a bolt by means of which the safety equipment is normally secured, characterized in that the movable member (10) consists of a face of a flexible pocket, and further characterized in that the support consists of two elements (3 and 4) forming a casing which is not leakproof and which completely encloses the safety equipment, its securing bolt, and the flexible pocket (10), one (3) of the elements being fixed to the unit such as a ship, the other element (4) forming a cover; wherein the two elements (3, 4) form two shells which are assembled along a joining plane (5); wherein the securing bolt consists of at least one latch ($12_2$) and notch (17) assembly which are each mounted on one of the elements of the support so that they are locked, one of these elements, latch or notch, being mounted so as to move on the element (3) of the support on which the pocket (10) is fixed and being connected, for its control, to the movable face ($10_1$) of this pocket.

19. A floating device for releasing safety equipment, this device being fixed on a unit such as a ship and comprising a support on which a movable member is fixed under an influence of hydrostatic pressure, this member acting on a bolt by means of which the safety equipment is normally secured, characterized in that the movable member (10) consists of a face of a flexible pocket, and further charcterized in that support consists of two elements (3 and 4) forming a casing which is not leakproof and which completely encloses the safety equipment, its securing bolt and the flexible pocket (10), one (3) of the elements being fixed to the unit such as a ship, the other element (4) forming a cover; wherein the element (4) of the support forming a cover is produced so as to float; wherein another of the faces ($10_2$) of the flexible pocket (10) is fixed to one of the elements (3) of the support whilst its movable face ($10_1$), under the influence of hydrostatic pressure, interacts with a securing bolt which assembles the two elements (3, 4) of the support; wherein the securing bolt consists of at least one jaw (36) pivoting on a spindle (37) mounted on the support (31) and by means of an anchoring flange (35) arranged at a lower end of the equipment, the jaw engaging on the flange by means of one of its ends and by means of its other end resting laterally on a finger (14) fixed to the movable face ($10_1$) of the flexible pocket (10).

20. The device according to claim 19, characterized in that each jaw consists of two elements (38, 39) articulated on the same spindle (37), said two elements being partially movable with respect to one another so as to allow, firstly, by means of a tilting of a first jaw element (38), a free passage of the flange (35) when the safety equipment is positioned on the base, then a locking of this first element engaged on the flange (35) by the second jaw element (39) resting on the finger of the flexible pocket.

21. The device according to claim 20, characterized in that at least one spring is provided to bring the pivoting jaw back to an initial position after pivoting.

22. A floating device for releasing safety equipment, this device being fixed on a unit such as a ship and comprising a support on which a movable member is fixed under an influence of hydrostatic pressure, a relatively rigid first face of this movable member acting on a bolt means by means of which the safety equipment is normally secured, characterized in that the movable member comprises: the relatively rigid first face; another second face which is fixed to the support, the first and second faces being substantially plane; a relatively flexible periphery portion which connects to the first and second faces, components of the movable member together forming an air-chamber.

23. An apparatus for releasing safety equipment, said apparatus being adapted to be fixed to a unit, such as a ship, said apparatus comprising:

a. a bolt means having a first secured position where said bolt means engages said safety equipment in a secured position, and said bolt means being moveable to a second release position where said safety equipment is released, b. a release actuating member which is responsive to hydrostatic pressure, said release actuating member comprising wall means defining a chamber to contain a gas, c. said wall means comprising a first relatively rigid wall portion which is operatively connected to said bolt means and a second relatively flexible wall portion, said wall means having three configurations:

i. a first expanded configuration which said wall means assumes under a normal ambient pressure range and higher ambient temperature, in which said first wall portion is positioned to have said bolt means in said first secured position, and said second wall portion is expanded so as to provide a greater volume in said chamber;

ii. a second configuration which said wall means assumes under said normal ambient pressure range and lower ambient temperature, and in which said first wall portion remains positioned to locate said bolt means in said first secured position, and the second wall portion has moved to a retracted position to provide a lesser intermediate volume of said chamber;

iii. a third configuration which said wall means assumes under a predetermined greater ambient pressure where said first wall portion is moved by ambient pressure to a release position of said first wall portion to move said bolt means to said release position, in a manner that under conditions of varying ambient temperature and ambient pressure within said normal ambient pressure range, said first wall portion remains in said position to maintain said bolt means in said secured position, and under a condition of ambient pressure greater than a predetermined level, the first wall portion moves the bolt means to release the safety equipment, whereby under a condition where said apparatus is surrounded by ambient air said bolt means remains in said first secured position and under a condition where said apparatus is submerged in water below a predetermined depth, said bolt means is moved to release the safety equipment.

24. The apparatus as recited in claim 23, wherein said first wall portion presents a pressure responsive surface which is exposed to ambient pressure exerted along a path having a substantial component parallel to a path made by said bolt means in moving from said secured position to said release position.

25. The apparatus as recited in claim 24, wherein said second wall portion is positioned to be responsive to pressure exerted in a direction transverse to said path of movement of said bolt means from said secured position to said release position.

26. The apparatus as recited in claim 23, wherein said second wall portion is arranged to be responsive to pressure so as to move in a direction which is transverse to an axis along which said bolt means moves in moving from said secured position to said release position.

27. The apparatus as recited in claim 23, wherein said release actuating member has a third wall portion which is positioned, relative to said chamber, oppositely from said first wall portion, and said first wall portion moves toward said third wall portion in moving to a location of said third configuration.

28. The apparatus as recited in claim 27, wherein said second wall portion is connected between said first and third wall portions.

29. The apparatus as recited in claim 28, wherein said second wall portion extends peripherally around said chamber and is operatively connected between said first and third wall portions.

* * * * *